US012698567B2

(12) United States Patent
Bardet et al.

(10) Patent No.: US 12,698,567 B2
(45) Date of Patent: Aug. 4, 2026

(54) SYSTEM AND PROCESS FOR STARTING UP AN ELECTROLYTIC CELL

(71) Applicant: ELYSIS LIMITED PARTNERSHIP, Montreal (CA)

(72) Inventors: Benoit Bardet, St-Étienne-de-Cuines (FR); Sebastien Becasse, St-Pierre-d'Albigny (FR); Leroy D'Astolfo, Lower Burrell, PA (US); John Fors, Kristiansand (NO); Alain Noizet, Grenoble (FR); Bruno Petitjean, Coublevie (FR)

(73) Assignee: ELYSIS LIMITED PARTNERSHIP, Montreal (CA)

( * ) Notice: Subject to any disclaimer, the term of this patent is extended or adjusted under 35 U.S.C. 154(b) by 538 days.

(21) Appl. No.: 17/922,127

(22) PCT Filed: Apr. 30, 2021

(86) PCT No.: PCT/CA2021/050609

§ 371 (c)(1),
(2) Date: Oct. 28, 2022

(87) PCT Pub. No.: WO2021/232147

PCT Pub. Date: Nov. 25, 2021

(65) Prior Publication Data

US 2023/0175156 A1 Jun. 8, 2023

Related U.S. Application Data

(60) Provisional application No. 63/018,680, filed on May 1, 2020.

(51) Int. Cl.
*C25C 3/20* (2006.01)
*C25C 3/12* (2006.01)

(52) U.S. Cl.
CPC . *C25C 3/20* (2013.01); *C25C 3/12* (2013.01)

(58) Field of Classification Search
CPC ..... C25C 3/06–24
See application file for complete search history.

(56) References Cited

U.S. PATENT DOCUMENTS 3,607,684 A * 9/1971 Kuhn ..... C25C 7/04 205/411
6,338,785 B1 1/2002 de Nora et al.
(Continued)

FOREIGN PATENT DOCUMENTS

CA 2872922 C 7/2016
CN 101709484 A 5/2003
(Continued)

OTHER PUBLICATIONS

Mohamed et al., "Recent Advances in Electrical Resistance Preheating of Aluminum Reduction Cells", The Journal of the Minerals, Metals & Material Society, Feb. 2017.
(Continued)

*Primary Examiner* — Ciel P Contreras
(74) *Attorney, Agent, or Firm* — Banner & Witcoff, Ltd.

(57) ABSTRACT

It is disclosed a system and process for starting up an electrolytic cell. The system and process are particularly adapted for preheating an electrolytic cell or pot having cathodes before installing preheated anodes in the cell, for the production of a metal (e.g. aluminum). The system comprises one or more electrical heaters installed in the cell in place of the anode assemblies and can be used with a dry bath or a liquid melted bath (e.g. cryolite). The cell is preferably preheated by as many cell preheaters as there are anode assemblies. The cell preheater is preferably powered by current available in the pot's busbar. The invention is environmentally friendly as being preferably adapted for preheating a cell working with inert or oxygen-evolving
(Continued)

anodes. Furthermore, the starting up process allows optimizing/reducing the time necessary for starting up the electrolytic cell, while securing the materials located inside the cell.

8 Claims, 10 Drawing Sheets

(56) References Cited

U.S. PATENT DOCUMENTS

| | | | |
|---|---|---|---|
| 6,551,489 | B2 | 4/2003 | D'Astolfo, Jr. et al. |
| 6,558,526 | B2 | 5/2003 | D'Astolfo, Jr. et al. |
| 7,485,215 | B2 | 2/2009 | Jouaffre et al. |
| 9,528,193 | B2 | 12/2016 | Yang et al. |
| 10,415,147 | B2 | 9/2019 | Liu |
| 2002/0079923 | A1 | 6/2002 | Nora et al. |
| 2003/0057102 | A1 | 3/2003 | Beck |
| 2004/0011661 | A1 | 1/2004 | Bradford et al. |
| 2015/0136612 | A1* | 5/2015 | Yang ..... C25C 3/08 205/390 |
| 2017/0275773 | A1* | 9/2017 | Liu ..... C25C 7/06 |
| 2022/0275529 | A1* | 9/2022 | Petitjean ..... C25C 3/12 |

FOREIGN PATENT DOCUMENTS

| | | | |
|---|---|---|---|
| CN | 201186954 | Y | 1/2009 |
| CN | 201762461 | U | 3/2011 |
| RU | 2717438 | C1 | 3/2020 |
| WO | 1995/06145 | A1 | 3/1995 |
| WO | 2013/016929 | A1 | 2/2013 |
| WO | 2014/015638 | A | 1/2014 |
| WO | 2021035356 | A | 3/2021 |

OTHER PUBLICATIONS

International Search Report of PCT/CA2021/050609 dated Aug. 9, 2021.

Extended European Search Report of corresponding EP application No. 21809020.7 dated Jul. 10, 2024.

* cited by examiner

SYSTEM AND PROCESS FOR STARTING UP AN ELECTROLYTIC CELL

CROSS-REFERENCE TO RELATED APPLICATIONS

The present non-provisional patent application is a U.S. National Phase of International Patent Application PCT/CA2021/050609, filed Apr. 30, 2021, which is hereby incorporated by reference in its entirety and which claims the benefits of priority of U.S. Provisional Patent Application No. 63/018,680 entitled "SYSTEM AND PROCESS FOR STARTING UP AN ELECTROLYTIC CELL", and filed at the United States Patent and Trademark Office on May 1, 2020, the content of which is incorporated herein by reference.

FIELD OF THE INVENTION

The present invention generally relates to a system and process thereof for starting up an electrolytic cell, such as by preheating the cell or pot before installing an anode assemblies in the preheated cell, for instance for the production of a metal, such as aluminum.

BACKGROUND OF THE INVENTION

In traditional Hall-Heroult cells with carbon anodes for the electrolytic production of aluminum, the cell is preheated before start-up either by gas or fuel burners (electrical circuit opened) or by Joule effect (electrical circuit closed) using a bed of carbonaceous material in between the anode and cathode to act as a resistor.

The use of a carbonaceous resistor bed is not chemically compatible with electrode material used for the making of inert electrodes, such as inert or oxygen-evolving anodes. Furthermore, when the bath will be melted at the end of the preheating, the loose particles of the carbonaceous bed will be floating in the bath and could have a detrimental effect on anode life.

The use of gas or fuel direct heating is not applicable to an inert anode cell whose lining may comprise some materials sensitive to thermal shock since, given the cell geometry, it is difficult to prevent the flame to be in contact with the materials and therefore difficult to guarantee a smooth and controlled heating curve and a uniform temperature in the whole cell.

There is thus a need for a new preheating system and process for preheating and starting up an electrolytic cell in the production of a metal, such as aluminum, that can be used with inert electrodes, such oxygen-evolving anodes.

SUMMARY OF THE INVENTION

The shortcomings of the prior art are generally mitigated by a new system and method for preheating an electrolytic cell typically used for the electrolytic production of a metal, such as aluminum, and a new process for starting us the electrolytic cell using said system or method.

The invention is first directed to a preheating system for preheating an electrolytic cell. The electrolytic cell comprises at least one cathode assembly and is configured for receiving at least one anode assembly and an electrolytic bath for the electrolytic production of a metal. The preheating system comprises at least one electrical heater configured to be installed in the electrolytic cell in place of the at least one anode assembly for preheating the cell before installing the at least one anode assembly into the cell.

According to a preferred embodiment, the at least one electrical heater is configured for providing a resistance $R_{CH}$ equivalent to a resistance $R_{AA}$ of the at least one anode assembly once installed in the bath, so that electrical and heat distribution of the electrolytic cell remain balanced during the replacement of the at least one electrical heater by the at least one anode assembly.

According to another preferred embodiment, the at least one electrical heater is configured for providing a variable resistance $R_{CH}$ which is configured to be tuned to be equivalent to a resistance $R_{AA}$ of the at least one anode assembly once installed in the bath, so that electrical and heat distribution of the electrolytic cell remain balanced during the replacement of the at least one electrical heater by the at least one anode assembly.

According to a preferred embodiment, the electrolytic cell is configured for receiving a number $N_{AA}$ of the at least one anode assembly, with $N_{AA} \geq 1$, the preheating system then comprising a number $N_{CH}$ of the at least one electrical heaters, with $N_{CH} \geq 1$. Each of the at least one electrical heater is configured to be installed in the electrolytic cell in place of the at least one anode assembly, with $N_{CH}=N_{AA}$; and further comprises a power module operatively connected to each of the at least one electrical heater for powering the at least one electrical heater with a current for preheating the electrolytic cell.

According to a preferred embodiment, the power module is configured to connect a main busbar of the electrolytic cell to each of the at least one electrical heater for providing the current available in the main busbar.

According to a preferred embodiment, the preheating system has a power P imposed by the current's amperage A and the resistance $R_{CH}$ of the $N_{CH}$ cell heaters, with $P=(R_{CH}/N_{CH})*A^2$, P being then higher than the power required to heat up the cell creating a surplus of energy, the cell being then configured to evacuate the surplus of heat.

According to a preferred embodiment, the preheating system further comprises at least one resistance located on a top section of the preheating system to evacuate said surplus of heat.

According to a preferred embodiment, the cathode and anode assemblies comprise respectively a plurality of vertical cathodes and vertical anodes.

According to a preferred embodiment, the preheating system as defined herein, may further be used for maintaining the preheated cell in temperature.

According to a preferred embodiment, the preheating system as defined herein, may further be used for replacing one defective anode assembly among the at least one anode assembly of the electrolytic cell during the production of the metal, and for maintenance and/or replacement of said defective anode assembly.

According to a preferred embodiment, the metal to be produced is aluminum, and the at least one anode assembly comprises inert or oxygen-evolving anodes.

The invention is also directed to a method for preheating an electrolytic cell, the electrolytic cell comprising at least one cathode assembly and being configured for receiving at least one anode assembly and an electrolytic bath for the electrolytic production of aluminum. The method comprises the step of: preheating the electrolytic cell with at least one electrical heater installed in the electrolytic cell in place of the at least one anode assembly.

According to a preferred embodiment, the method as defined herein may further comprise the steps of: incorporating in the electrolytic cell the electrolytic bath once a given temperature of the electrolytic cell has been reached; and replacing the at last one electrical heater by the at least one anode assembly.

According to a preferred embodiment, the step of preheating the electrolytic cell may comprise the step of: providing a resistance $R_{CH}$ equivalent or almost equivalent to a resistance $R_{AA}$ of the at least one anode assembly in the bath so that electrical and heat distribution of the cell remain balanced during the replacement of the electrical heaters by the anode assemblies.

According to a preferred embodiment, the step of preheating the electrolytic cell may comprise the steps of: providing a variable resistance $R_{CH}$ to the at least one electrical heater; and tuning the variable resistance $R_{CH}$ until to be equivalent to a resistance $R_{AA}$ of the at least one anode assembly once installed in the bath, so that electrical and heat distribution of the electrolytic cell remain balanced during the replacement of the at least one electrical heater by the at least one anode assembly.

According to a preferred embodiment, the electrolytic cell is configured for receiving a number $N_{AA}$ of at least one anode assembly, with $N_{AA} \geq 1$, the method comprising the steps of: installing a number $N_{CH}$ of electrical heaters in the electrolytic cell, with $N_{CH} \geq 1$, in place of the at least one anode assembly, with $N_{CH} = N_{AA}$; and powering each of the at least one electrical heater with a current for heating the electrolytic cell.

According to a preferred embodiment, the step of powering each of the at least one electrical heater comprises the step of: providing the current available in a main busbar of the electrolytic to each of the at least one electrical heater.

According to a preferred embodiment, the method as defined herein may further comprise during the preheating of the electrolytic cell the step of: evacuating a surplus of heat from the cell.

According to a preferred embodiment, the method as defined herein may further comprise the step of: maintaining the preheated cell in temperature by powering at least one of the at least one electrical heater installed in the electrolytic cell in place of the at least one anode assembly.

According to a preferred embodiment, the method as defined herein may further comprise the step of: replacing one defective anode assembly among the at least one anode assembly of the electrolytic cell during the production of the metal for maintenance and/or replacement of said defective anode assembly.

According to a preferred embodiment, the metal to be produced by the method as defined herein is aluminum, and the at least one anode assembly comprises a plurality of inert or oxygen-evolving anodes, more preferably according to a vertical configuration of the electrodes.

The invention is further directed to a process for starting up an electrolytic cell for producing a metal, the electrolytic cell comprising at least one cathode assembly and being configured for receiving at least one anode assembly and an electrolytic bath for the electrolytic production of the metal, the electrolytic bath being a dry bath at ambient temperature. The process comprises:

- providing the dry bath at ambient temperature in the electrolytic cell;
- installing, at ambient temperature, at least one heating element in the electrolytic cell in place of the at least one anode assembly;
- heating the electrolytic cell by supplying each of the at least one heating element with a current;
- once a given temperature in the electrolytic cell is reached, controlling that the dry bath has melted thanks to the at least one heating element, and optionally injecting into the electrolytic cell a portion of electrolytic bath in its liquid form to complete the electrolytic cell;
- injecting a portion of the metal to be produced into the electrolytic cell; and
- replacing one or more of the at least one heating elements by an anode assembly until that each of the at least one heating element is removed from the electrolytic cell.

The invention is yet further directed to a process for starting up an electrolytic cell for producing a metal, the electrolytic cell comprising at least one cathode assembly and being configured for receiving at least one anode assembly and an electrolytic bath for the electrolytic production of the metal, the electrolytic bath being a liquid melted bath. The process comprises:

- installing, at ambient temperature, at least one heating element in the electrolytic cell in place of the at least one anode assembly;
- heating the electrolytic cell by supplying each of the at least one heating element with a current;
- once a given temperature in the electrolytic cell is reached, pouring the liquid melted bath and optionally a portion of the metal to be produced in the electrolytic cell; and
- replacing one or more of the at least one heating element by an anode assembly until that each of the at least one heating element is removed from the electrolytic cell.

According to a preferred embodiment of the two above mentioned processes (with dry or liquid bath), for one anode assembly to be installed in the electrolytic cell, a number $N_{HE}$ of heating elements is removed from the electrolytic cell, with $N_{HE} \geq 1$ and $N_{HE}$ depending on a total resistance R provided by the $N_{HE}$ heating elements, R being selected to be close or almost equivalent to a resistance $R_{AA}$ of said at least one anode assembly.

According to a preferred embodiment, each of the heating elements comprises at least one electrical resistance, wherein each of the at least one electrical resistance is electrically connected in parallel when there is more than one of said at least one electrical resistance.

According to a preferred embodiment, the electrolytic cell is further heated by distributing heat produced inside the electrolytic cell towards the at least one cathode assembly. Preferably, distributing the heat inside the electrolytic cell is performed in consideration of a ramp up in temperature, the ramp up in temperature depending on a nature of materials to be heated inside the electrolytic cell.

According to a preferred embodiment, the two above mentioned processes (with dry or liquid bath) may further comprise the step of: evacuating a surplus of heat from the electrolytic cell. Preferably, evacuating the surplus of heat is performed by having at least one additional resistance located on a top section of the at least one heating element. More preferably, the surplus of heat may be evacuated from the electrolytic cell via a gas evacuation system of the electrolytic cell located on a top section of the electrolytic cell.

According to a preferred embodiment, the two above mentioned processes (with dry or liquid bath), may further comprise the step of: protecting from heat lateral walls of the electrolytic cell. Preferably, protecting from heat the lateral walls comprises the step of: forcing a circulation of heat from the at least one heating element to the at least one cathode assembly by the use of protective materials extending from the lateral walls.

According to a preferred embodiment, for the two above mentioned processes (with dry or liquid bath), the given temperature of the preheated electrolytic cell is reached after a period of time of between 2 to 5 days, and is between 700 and 1000° C. Preferably, the metal to be produced is aluminum, and the at least one anode assembly comprises inert or oxygen-evolving anodes.

The invention is environmentally friendly as being particularly adapted for preheating electrolytic cells using inert or oxygen-evolving anodes, with or without the electrolytic bath into the cell before installing the anode assemblies in the electrolytic bath.

Other and further aspects and advantages of the present invention will be better understood upon the reading of the illustrative embodiments about to be described or will be indicated in the appended claims, and various advantages not referred to herein will occur to one skilled in the art upon employment of the invention in practice.

BRIEF DESCRIPTION OF THE DRAWINGS

The above and other aspects, features and advantages of the invention will become more readily apparent from the following description, reference being made to the accompanying drawings in which.

DETAILED DESCRIPTION OF PREFERRED EMBODIMENTS

Figure 1:
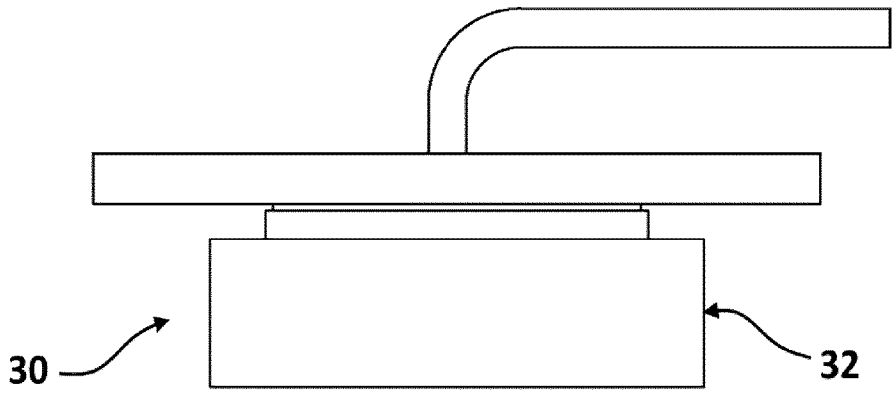
FIG. 1 is a schematic illustration of an anode assembly according to a preferred embodiment.

A novel system, method and processes will be described hereinafter. Although the invention is described in terms of specific illustrative embodiments, it is to be understood that the embodiments described herein are by way of example only and that the scope of the invention is not intended to be limited thereby.

The description which follows, and the embodiments described therein are provided by way of illustration of an example of particular embodiments of principles and aspects of the present invention. These examples are provided for the purposes of explanation and not of limitation, of those principles of the invention. In the description that follows, like parts and/or steps are marked throughout the specification and the drawing with the same respective reference numerals.

The terminology used herein is in accordance with definitions set out below.

By "about", it is meant that the value of time, resistance, amperage, volume or temperature can vary within a certain range depending on the margin of error of the method or device used to evaluate such time, resistance, amperage, volume or temperature.

The expression "anode assembly" used herein is meant to encompass one single anode or a plurality of anodes.

The expression "cathode assembly" used herein is meant to encompass one single cathode or a plurality of cathodes.

As aforesaid, the invention as disclosed herein is first directed to a preheating system for preheating an electrolytic cell.

Figure 3:
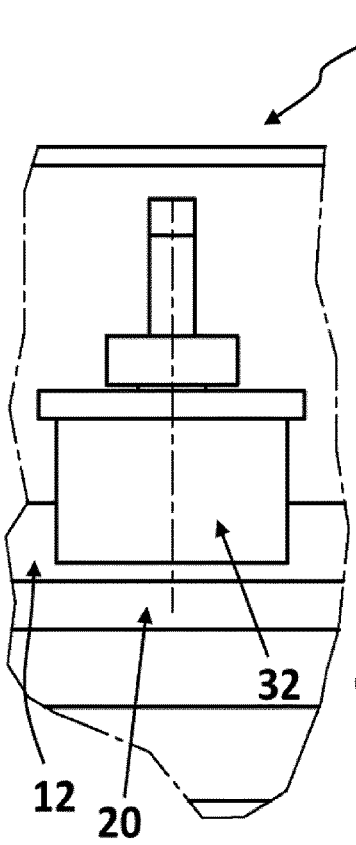
FIG. 3 is a lateral cross-sectional view of the electrolytic cell illustrated in FIG. 2 along the line A-A, according to a preferred embodiment.
Figure 2:
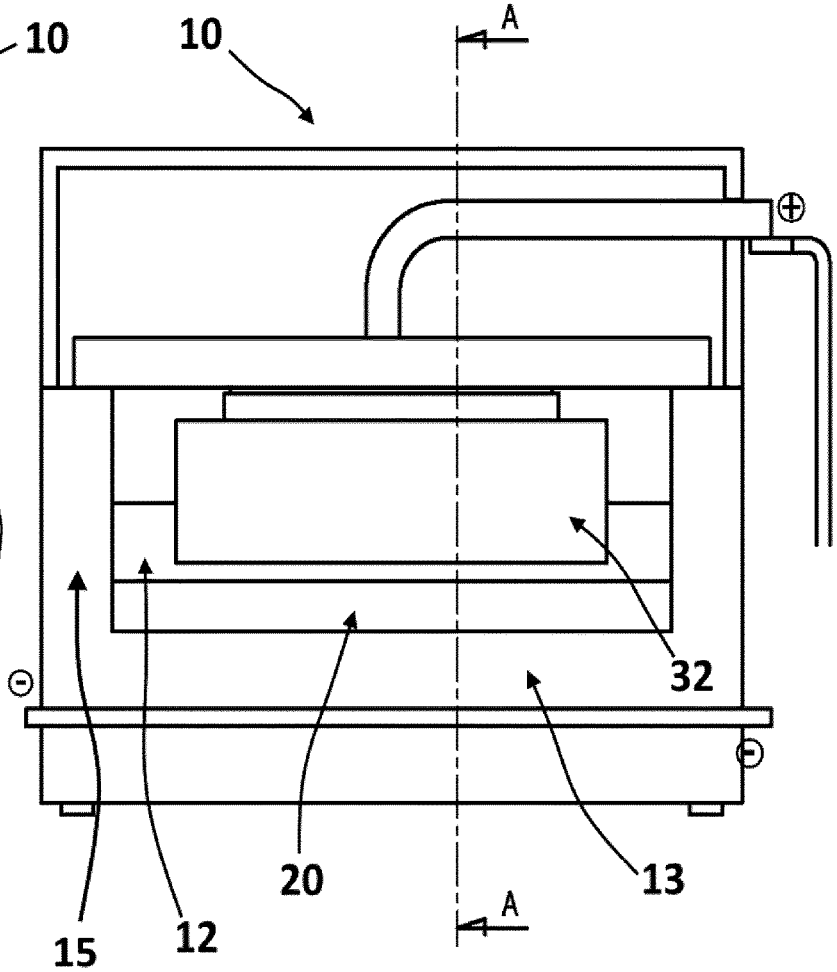
FIG. 2 is a front view of an electrolytic cell with vertical anode and cathode assemblies according to a preferred embodiment.

As illustrated on FIGS. 2 and 3, the electrolytic cell 10, or merely cell or pot herein after, typically comprises a bottom wall 13 and lateral walls 15 extending therefrom, and is configured to receive an electrolytic bath 12 for the electrolytic production of a metal, such as aluminum. The bath 12 can be either a dry solid bath at ambient temperature to be melted, or a liquid molten bath comprising an electrolyte, such as cryolite ($Na_3AlF_6$). The cell 10 also comprises at least one cathode assembly 20 having at least one cathode, such as, but not limited to vertical cathodes.

The cell 10 is further configured for receiving at least one corresponding anode assembly 30, as the one illustrated on FIG. 1. The anode assembly 30 has at least one anode 32. Preferably, the anode assembly 30 comprises a plurality of vertical anodes, extending downwardly towards the cathode assembly once inserted into the cell (FIGS. 2 and 3). An example of an electrolytic cell comprising vertical cathodes assemblies or modules, and vertical anode assemblies or modules, is disclosed in U.S. Pat. No. 10,415,147 B2 (ELYSIS LIMITED PARTNERSHIP), the content of which is incorporated herewith by reference. Other electrolytic cell configurations can be considered within the scope of the present invention.

Figure 4:
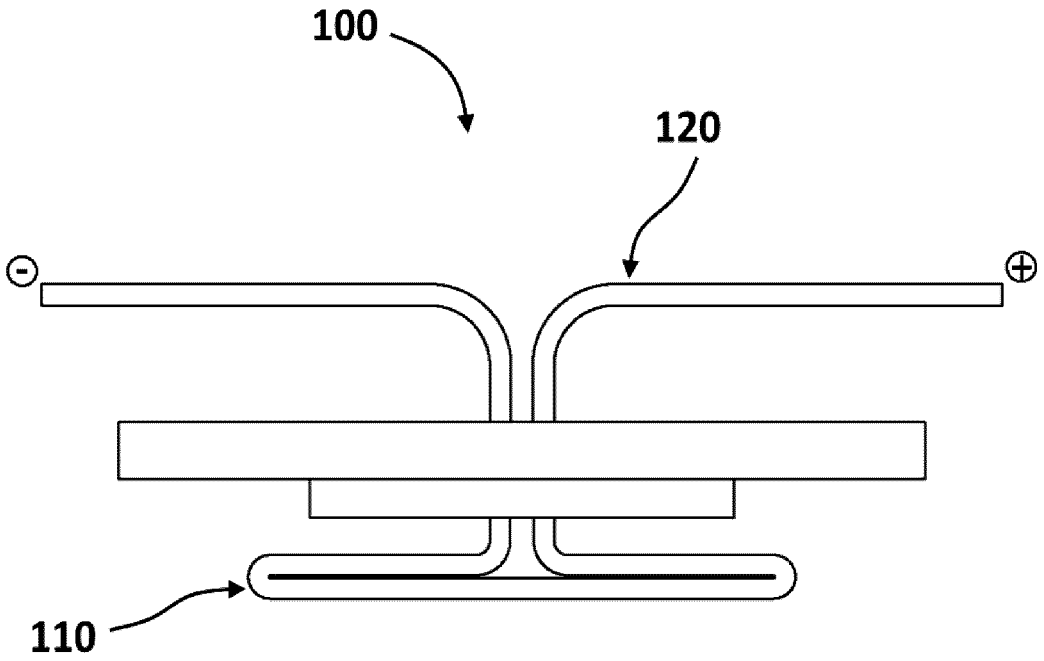
FIG. 4 is a schematic front view of a cell preheater according to a preferred embodiment.
Figure 5:
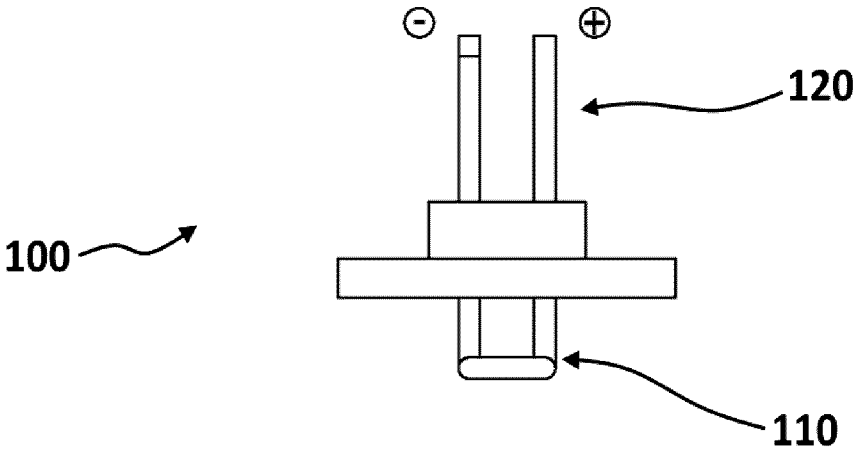
FIG. 5 is a schematic lateral view of the cell preheater illustrated in FIG. 4, according to a preferred embodiment.
Figure 6:
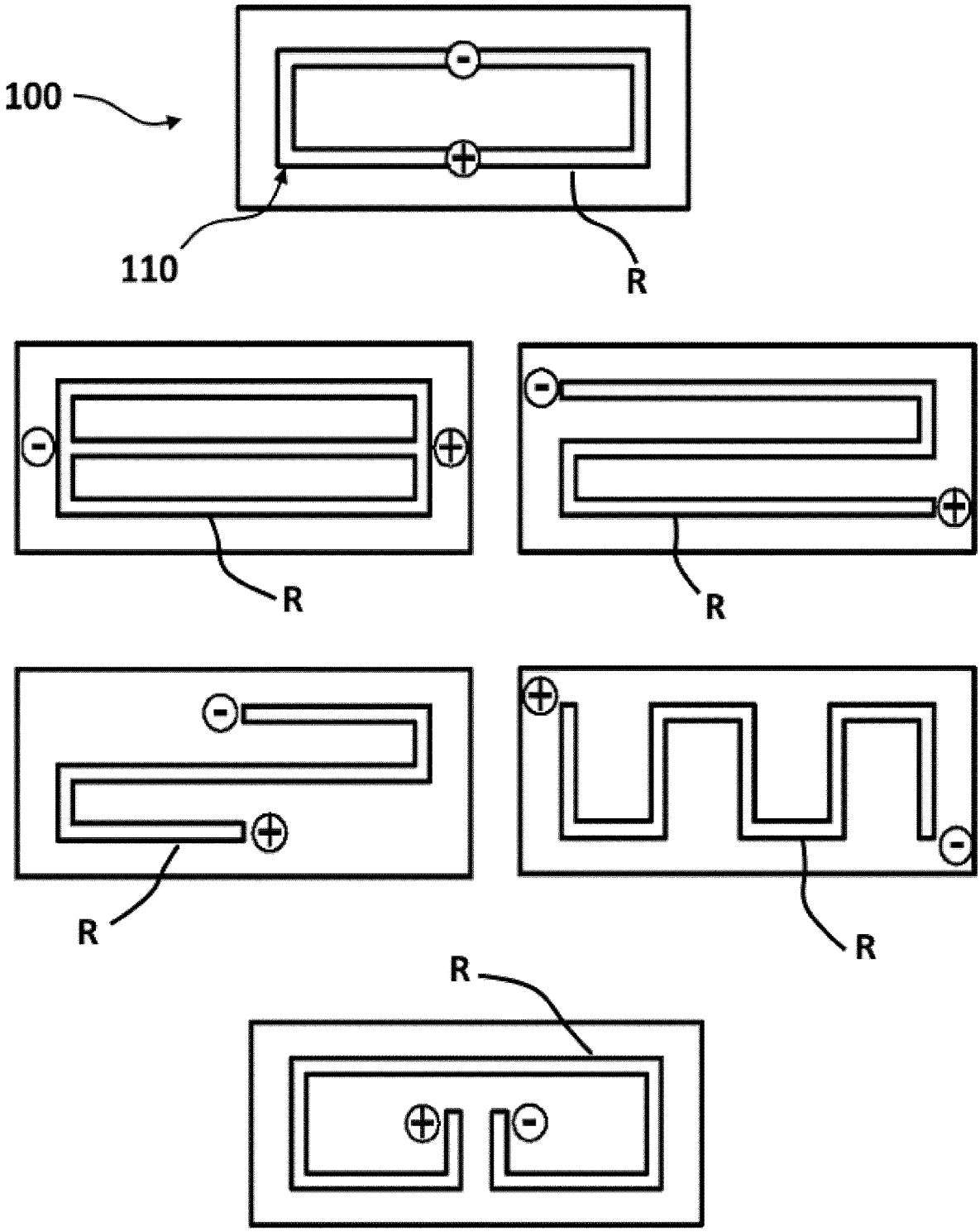
FIG. 6 are schematic bottom views of the cell preheater illustrated in FIGS. 4 and 5, according to different preferred embodiments.

A preheating system in accordance with a preferred embodiment of the invention is illustrated on FIGS. 4 and 5. The preheating system 100 may comprise at least one electrical heater 110 and is configured to be installed in the electrolytic cell in place of the corresponding anode assembly as illustrated on FIGS. 7 and 8, for preheating the cell before installing the corresponding anode assembly into the cell. As illustrated in FIG. 6, the electrical heater 110 may comprise a resistance (R) with different configurations.

According to a preferred embodiment, each electrical heater 110 is configured for providing a resistance $R_{CH}$ close to or equivalent to a resistance $R_{AA}$ of the corresponding anode assembly in the bath. Alternatively, the resistance $R_{CH}$ can be variable and outsourcely tuned to be equivalent to the resistance $R_{AA}$ of the anode assembly once installed in the bath. In both cases, a resistance $R_{CH}$ close to or equivalent to a resistance $R_{AA}$ allows the electrical and heat distribution of the cell remaining balanced during the replacement of the electrical heaters by the anode assemblies before introducing the electrolytic bath into the cell. According to another preferred embodiment, some excess heat can be permitted, to compensate for the dissipation of heat on top of the preheaters.

According to a preferred embodiment, the electrolytic cell 10 may comprise one or more cathode assemblies 20 and is configured for receiving a number $N_{AA}$ of corresponding anode assemblies 30. The preheating system 100 then may comprise a number $N_{CH}$ of electrical cell heaters, and is configured to be installed in the cell 10 in place of the corresponding anode assembly, with $N_{CH}=N_{AA}$. As illustrated on FIG. 9, the number of electrical heaters (resistance) can also be superior to the number of anode assemblies. A power module 120 may be operatively connected to each of the electrical heaters 110 for powering the electrical heaters with a current for generating heat for heating the electrolytic cell 10. The current can be have a fixed or variable intensity.

Figure 7:
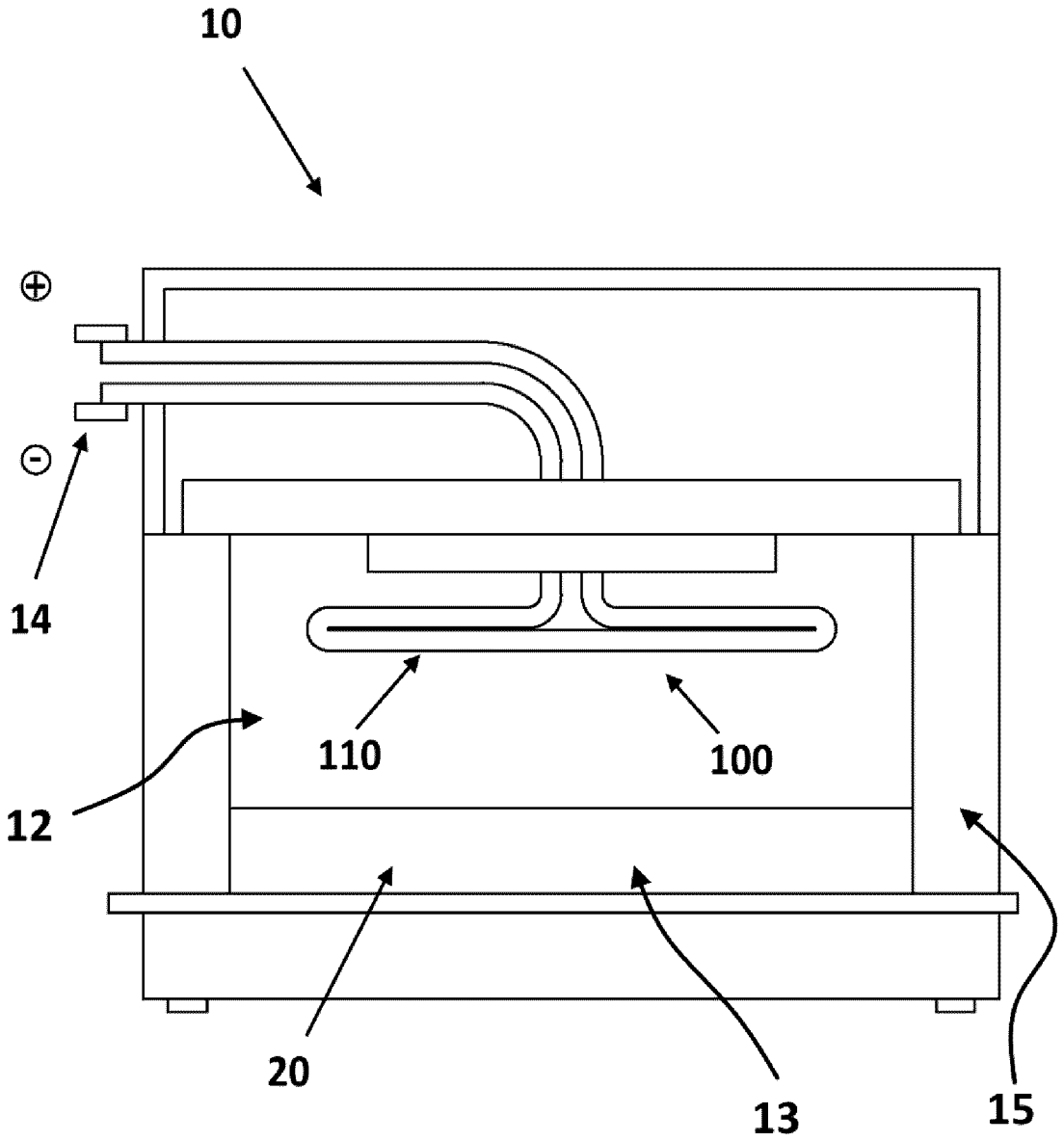
FIG. 7 is a schematic illustration of a cell preheater installed into the electrolytic cell or pot, and connected to the power loop, according to a preferred embodiment.

According to a preferred embodiment, such as the one illustrated in FIG. 7, the power module is configured to connect the power loop 14 of the cell 10 to each of the electrical heaters for providing the current.

Figure 8:
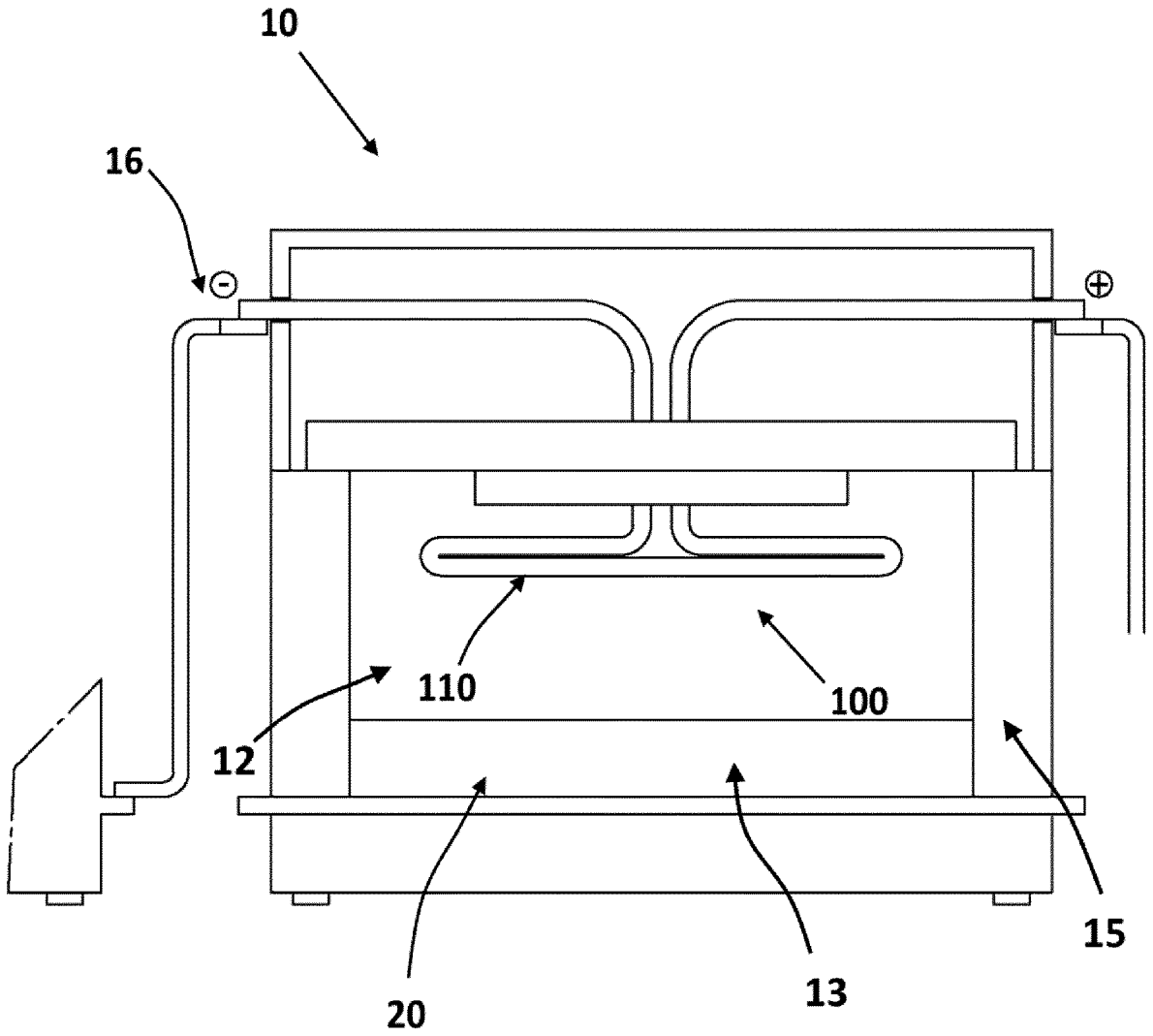
FIG. 8 is a schematic illustration of a cell preheater installed into the electrolytic cell or pot, and connected to the pot busbar, according to another preferred embodiment.

According to a preferred embodiment, such as the one illustrated in FIG. 8, the power module is configured to connect a main busbar 16 of the electrolytic cell to each of the electrical heaters for providing the current available in the main busbar. The current may be provided to the cell preheaters from the potline busbars with a current having a very low voltage (e.g. direct current of 2 to 5 volts) and a very high amperage (e.g. of 15 to 50 kA). Alternatively, whole or part of the power may be supplied from an external source.

According to a preferred embodiment, the preheating system has a power P imposed by the amperage A of the current and the resistance $R_{CH}$ of the $N_{CH}$ cell heaters, with: $P=(R_{CH}/N_{CH})*A^2$. P is then higher than the power required to heat up the cell creating a surplus of energy. The cell preheaters may then be configured to evacuate this surplus of energy.

Figure 11:
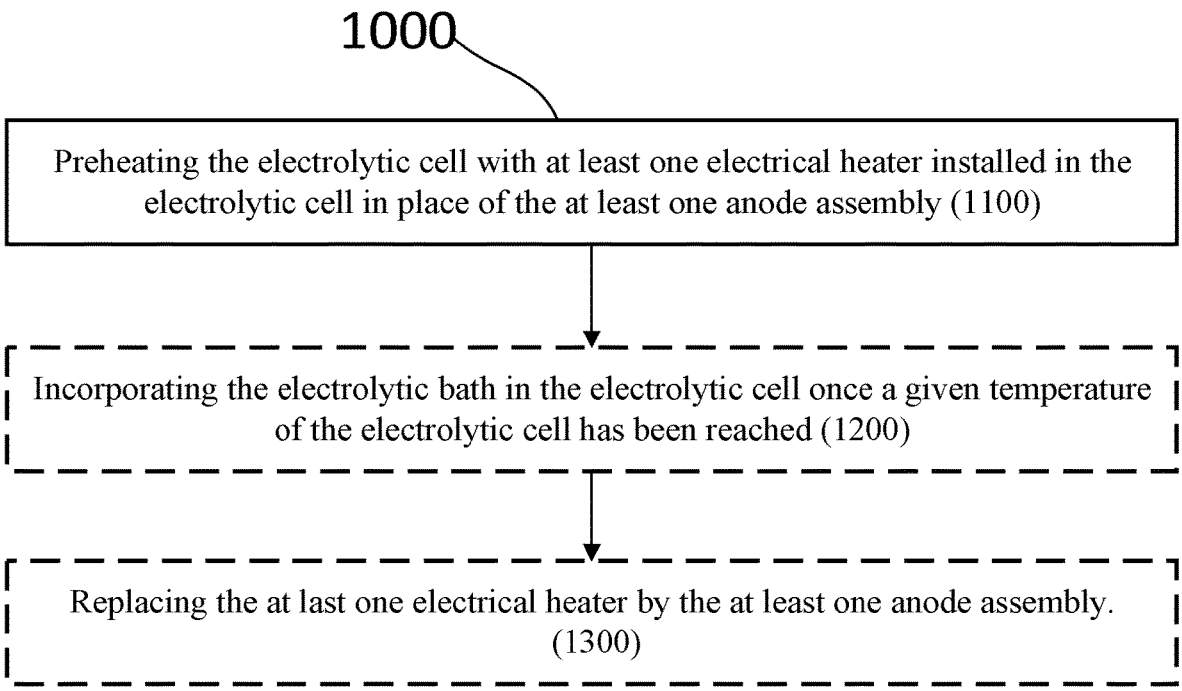
FIG. 11 is flow chart illustrating the preheating method according to a preferred embodiment.

As aforesaid, the invention as disclosed herein is further directed to a method for preheating an electrolytic cell comprising at least one vertical cathode assembly and configured for receiving at least one corresponding vertical anode assembly and an electrolytic bath for the electrolytic production of aluminum. As illustrated on FIG. 11, the method 1000 comprises the step of preheating the cell with at least one electrical heater installed in the electrolytic cell in place of the corresponding anode assembly 1100. Preferably, the method 1000 further comprises the steps of incorporating the electrolytic bath in the electrolytic cell once a given temperature of the electrolytic cell has been reached 1200; before replacing the at last one electrical heater by the at least one anode assembly 1300.

Figure 12:
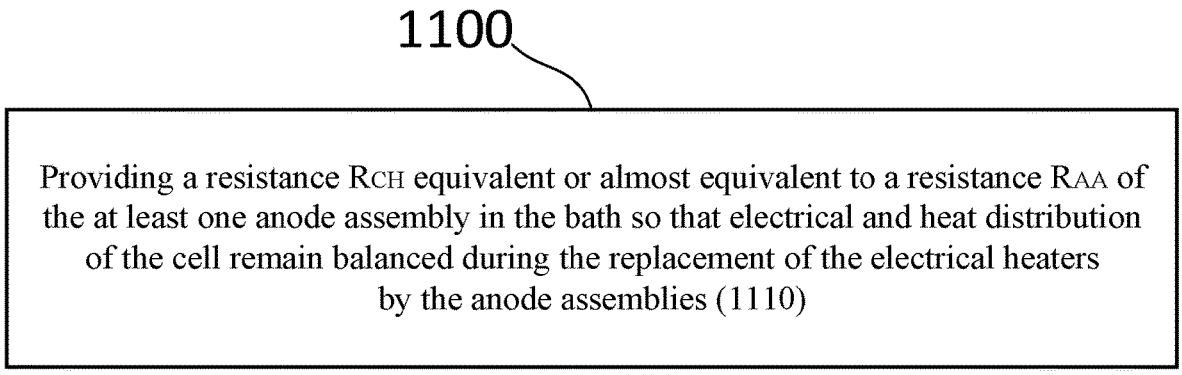
FIG. 12 is flow chart illustrating the preheating step of the method of FIG. 11, according to a first preferred embodiment.

According to a preferred embodiment illustrated on FIG. 12, the preheating step 1100 of the method 1000 may consist in providing a resistance $R_{CH}$ almost equivalent to a resistance $R_{AA}$ of the at least one anode assembly in the bath so that electrical and heat distribution of the cell remains balanced during the replacement of the electrical heaters by the anode assemblies 1110.

Figure 13:
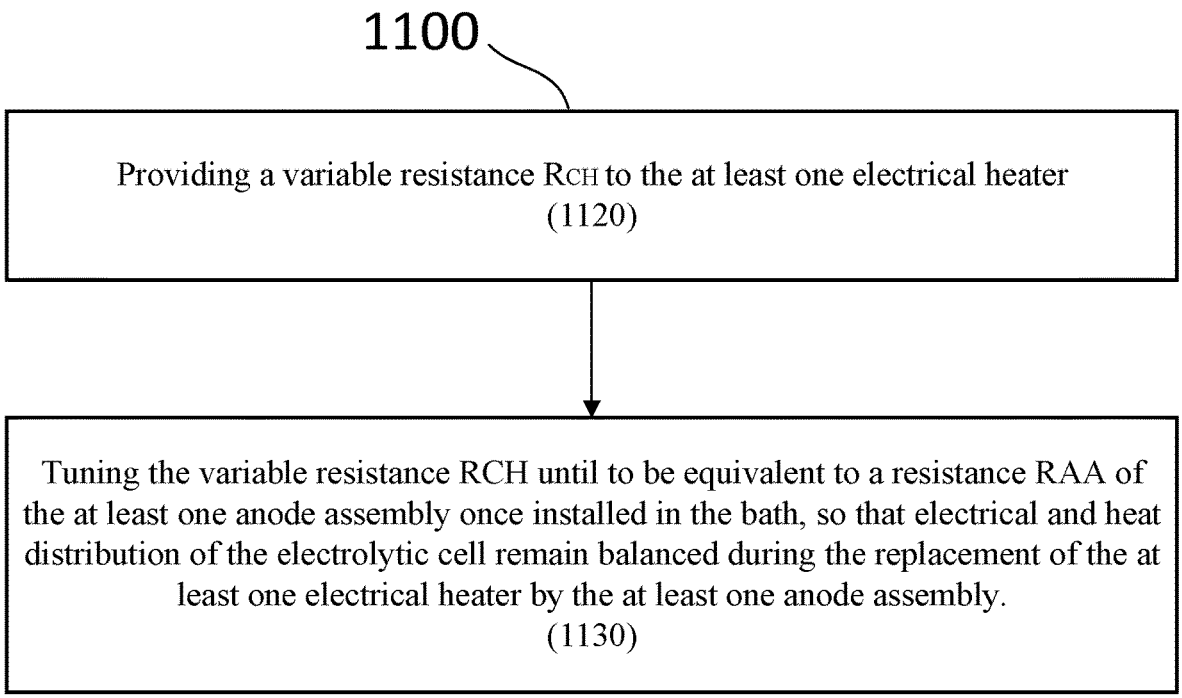
FIG. 13 is flow chart illustrating the preheating step of the method of FIG. 11 according to a second preferred embodiment.

According to another preferred embodiment as the one illustrated on FIG. 13, the preheating step 1100 may first comprises the step of providing a variable resistance $R_{CH}$ to the at least one electrical heater 1120; followed by the step of tuning the variable resistance $R_{CH}$ until to be equivalent to a resistance $R_{AA}$ of the at least one anode assembly once installed in the bath, so that electrical and heat distribution of the electrolytic cell remain balanced during the replacement of the at least one electrical heater by the at least one anode assembly 1130. Tuning the resistance $R_{CH}$ can be performed by modulating the amount of current provided by the resistance.

According to a preferred embodiment, the electrolytic cell is configured for receiving a number $N_{AA}$ of at least one anode assembly, with $N_{AA}\geq 1$. The method 1000 then may comprise the step of installing a number $N_{CH}$ of electrical heaters in the electrolytic cell, with $N_{CH}\geq 1$, in place of the at least one anode assembly, with $N_{CH}=N_{AA}$; before powering each of the at least one electrical heater with a current for heating the electrolytic cell. Preferably, powering each of the at least one electrical heater may comprises the step of providing the current available in a main busbar of the electrolytic to each of the at least one electrical heater. The current provided to the heaters is preferably available in the main busbar of the pot. For example, the current available in the busbar may have a very low voltage (e.g. direct current of 2 to 5 volts) and a very high amperage (e.g. of 15 to 50 kA).

According to a preferred embodiment, the method 1000 may further comprise during the preheating of the electrolytic cell the step of evacuating a surplus of heat from the cell.

According to a preferred embodiment, the method 1000 may further comprise the step of maintaining the preheated cell in temperature by powering at least one of the at least one electrical heater installed in the electrolytic cell in place of the at least one anode assembly.

According to a preferred embodiment, the method 1000 may further comprise the step of replacing one defective anode assembly among the at least one anode assembly of the electrolytic cell during the production of the metal for maintenance and/or replacement of said defective anode assembly.

According to a preferred embodiment, the method may further comprise evacuating a surplus of energy from the cell. A way to evacuate the energy surplus is given hereinafter.

According to a preferred embodiment, the metal to be produced after the starting-up of the cell is aluminum, and the anode assembly comprises inert or oxygen-evolving anodes.

A process for starting up an electrolytic cell for producing a metal is also disclosed herein. The electrolytic cell typically comprises at least one cathode assembly configured for receiving at least one anode assembly and an electrolytic bath for the electrolytic production of a metal, such as aluminum. The electrolytic bath can be solid or liquid. A solid bath typically comprises solid cryolite and preferably other additives at ambient temperature, and the electrolytic cell is then filled with the solid bath before the next steps of the process. A liquid bath typically comprises already melted cryolite and preferably other additives at a given temperature (typically above 700° C.).

Figure 9:
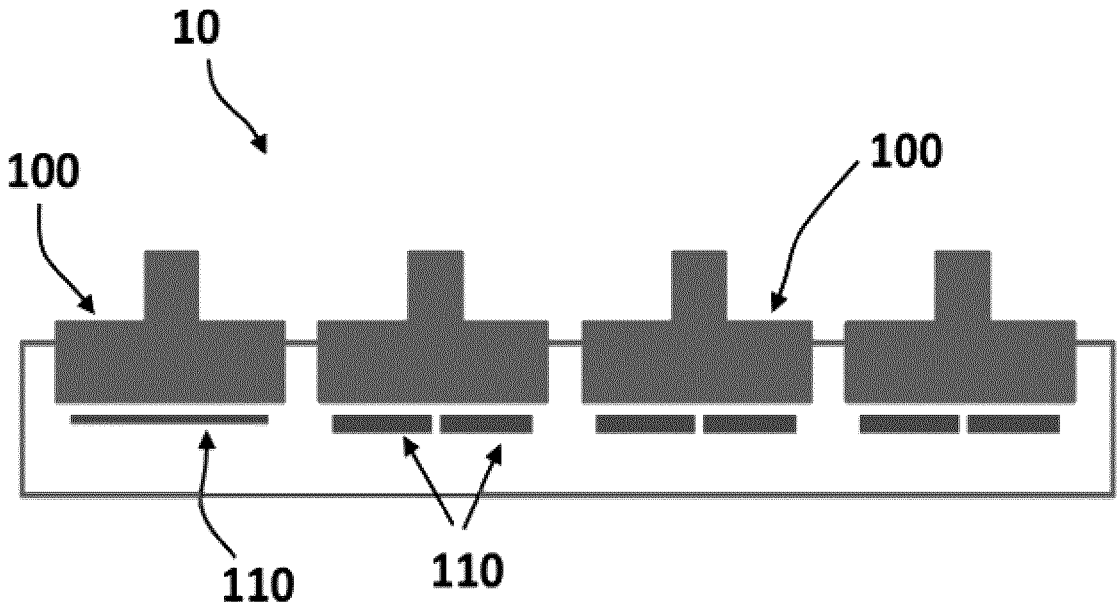
FIG. 9 is a schematic illustration of a plurality of cell preheaters installed into the cell according to another preferred embodiment.
Figure 10:
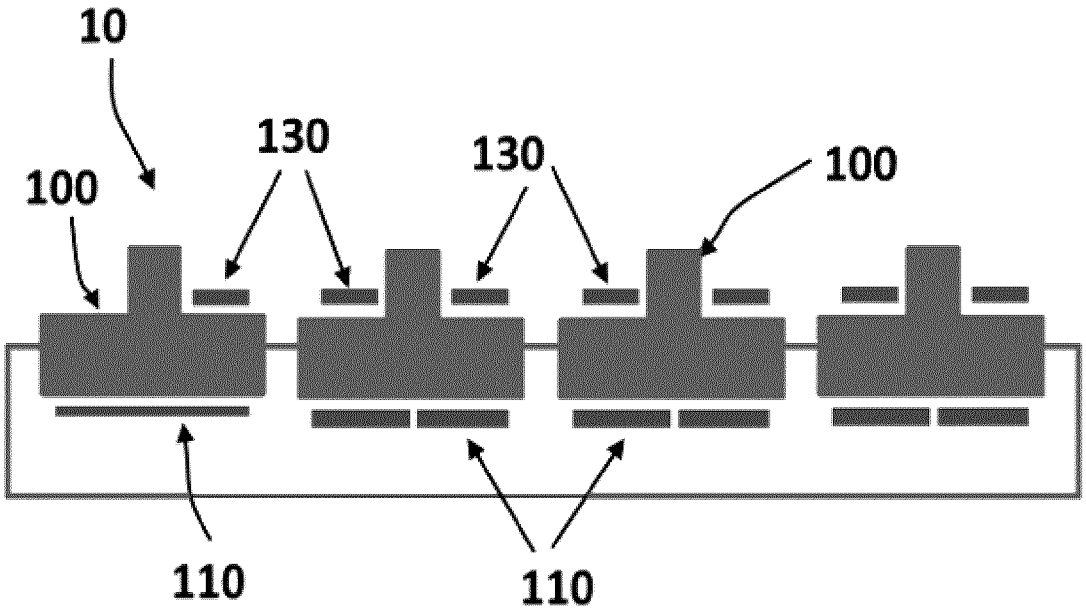
FIG. 10 is a schematic illustration of a plurality of cell preheaters installed into the cell with resistance on the top of the cell preheaters to dissipate a surplus of heat, according to another preferred embodiment.
Figure 14:
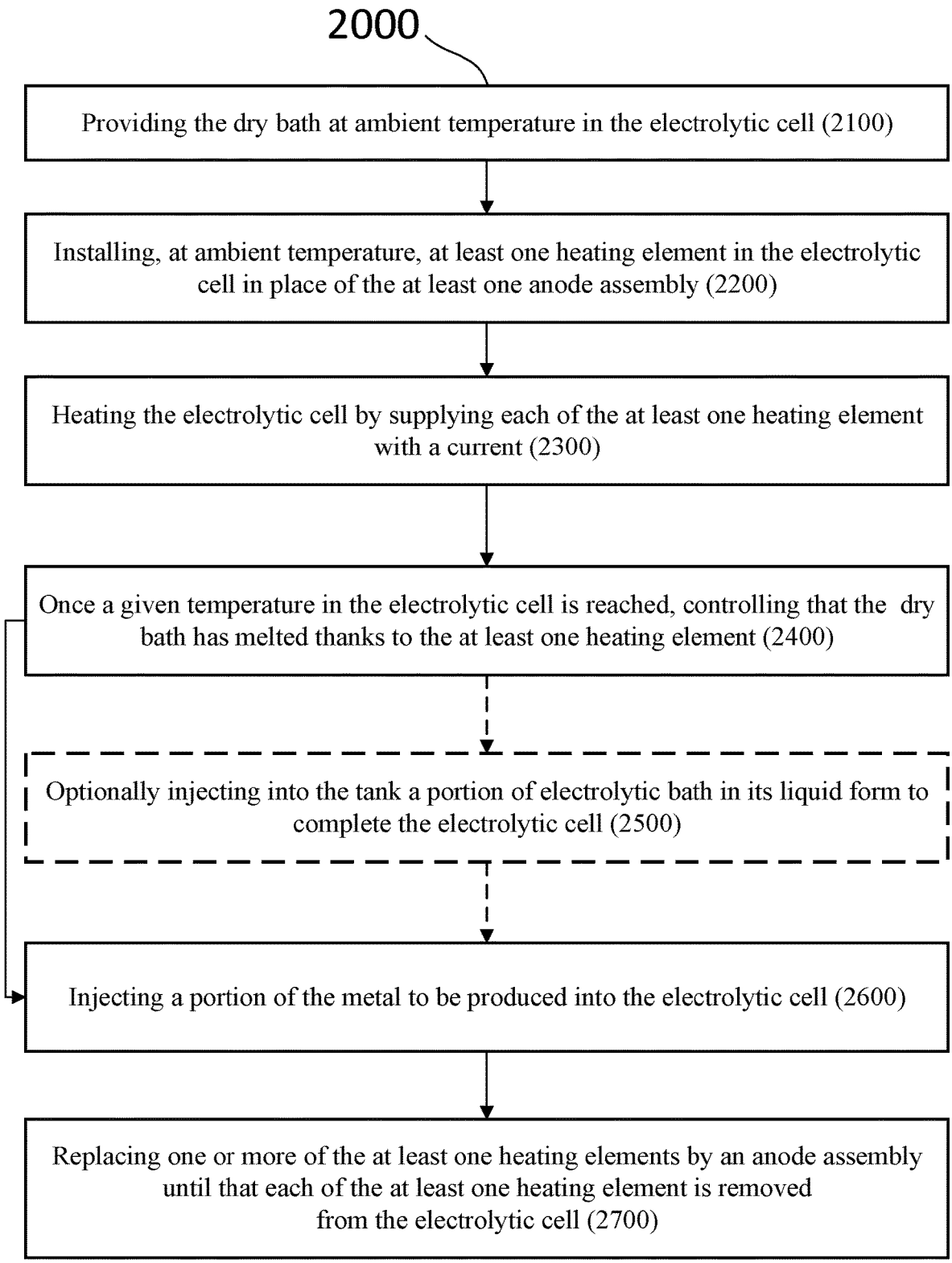
FIG. 14 is flow chart illustrating the starting-up process using a dry bath, according to a preferred embodiment.

The starting-up process when the electrolytic bath is a dry bath is illustrated on FIG. 14. The process 2000 first comprises the steps of providing the dry bath at ambient temperature in the electrolytic cell 2100, before installing, at ambient temperature, at least one heating element in the electrolytic cell in place of the corresponding anode assembly 2200. As illustrated in FIGS. 9 and 10, each electrolytic cell 10 may have several cell preheaters 100, each of the cell preheaters having electrical heaters 110 with one or more resistances. Each of the resistances 110 may have a different geometry, as the ones illustrated in FIG. 6.

By "ambient temperature", it is meant a temperature of the direct environment of the hydrolytic cell(s), for instance a temperature of 25° C.±15° C. In fact, the ambient temperature around an hydrolytic cell (pot) in the potroom could be higher due to the heat generated from adjacent pots, especially in hot climates. Alternatively, the ambient temperature could also be lower, especially in Canada, where potrooms are generally not heated, the ambient temperature being maintained by the heat generated by the hydrolytic cells or pots.

Preferably, the $N_{CH}$ electrical resistances $R_{CH}$ of electrical heaters 110 are typically connected, such as in parallel, when there is more than one electrical resistance to form the preheating system 100. In a system with multiple $N_{CH}$ equal resistances $R_{CH}$ in parallel, the overall resistance is then $R=R_{CH}/N_{CH}$. Other types of connections for the resistance can be considered without departing from the scope of the present invention. As illustrated on FIG. 9 or 10, each of the heating elements is preferably installed on the top section of the electrolytic cell in place of the anode assemblies with a resistance extending from the top toward the cathodes typically located at the bottom section of the electrolytic cell. Other configurations can be considered without departing from the scope of the present invention.

The process 2000 as illustrated on FIG. 14 may further comprise the step heating the electrolytic cell by supplying each heating elements with a current 2300. Preferably, the current is available in the busbar of the cell. The busbars are conductive bars, typically made of copper or aluminum, more preferably aluminum, which allow the electrical current to flow from a power source to the electrodes (e.g. Ref 16, FIG. 8).

Preferably, the electrolytic cell 10, and eventually the dry bath presents therein 12, may further be heated by advantageously distributing the heat inside the electrolytic cell towards the at least one cathode assembly 20. For instance, the heat may be advantageously distributed inside the electrolytic cell in consideration of a ramp up in temperature, the ramp up in temperature depending on a nature of materials to be heated inside the electrolytic cell. In that sense, the electrolytic cell may have protective materials for protecting the side walls 13. For instance, heat circulation is oriented from the heating element(s) 110 to the at least one cathode assembly 20 by the use of the protective materials extending from the lateral or side walls of the electrolytic cell. It has to be noted that the cell preheaters in accordance with the present invention have sidewalls Preferably, the side walls of the preheaters not need to be made of materials sensitive to heating ramp rates, since they are generally in contact with adjacent preheaters (See e.g. FIG. 9).

As illustrated on FIG. 14, the process 2000 using a dry bath further comprises the step of controlling that the dry bath in the electrolytic cell has melted thanks to the heating element(s) 2400 once the given temperature in the pot is reached, as detailed herein after. The present invention is also advantageous in that it allows preheating the cell while melting the dry bath with the heating elements.

As illustrated on FIG. 14, the process 2000 may optionally comprises the step of injecting into the electrolytic cell a portion of liquid melted bath to complete the electrolytic cell 2500, if necessary for the running the electrolytic process of making the metal (e.g. aluminum). Indeed, when a dry bath is used, the volume of the bath will decrease when it is melted, and a portion of liquid bath is then added to complete the electrolytic cell.

As illustrated on FIG. 14, the process 2000 further comprises the step of injecting in the cell 10 a portion of the metal to be produced 2600, such as aluminum, so as to wet the cathodes 20 and the cell bottom 13 (see more details herein after).

Finally, as illustrated on FIG. 14, the process 2000 further comprises the step of replacing each of the heating elements by an anode assembly until that all heating elements are removed from the electrolytic cell 2700. In particular, for one anode assembly to be installed in the electrolytic cell, a number $N_{HE}$ of heating elements is removed therefrom, with $N_{HE}\geq 1$ and $N_{HE}$ depending on a total resistance $R_{CH}$ provided by the $N_{HE}$ heating elements, $R_{CH}$ being close or almost equivalent to a resistance $R_{AA}$ of said one anode assembly.

Figure 15:
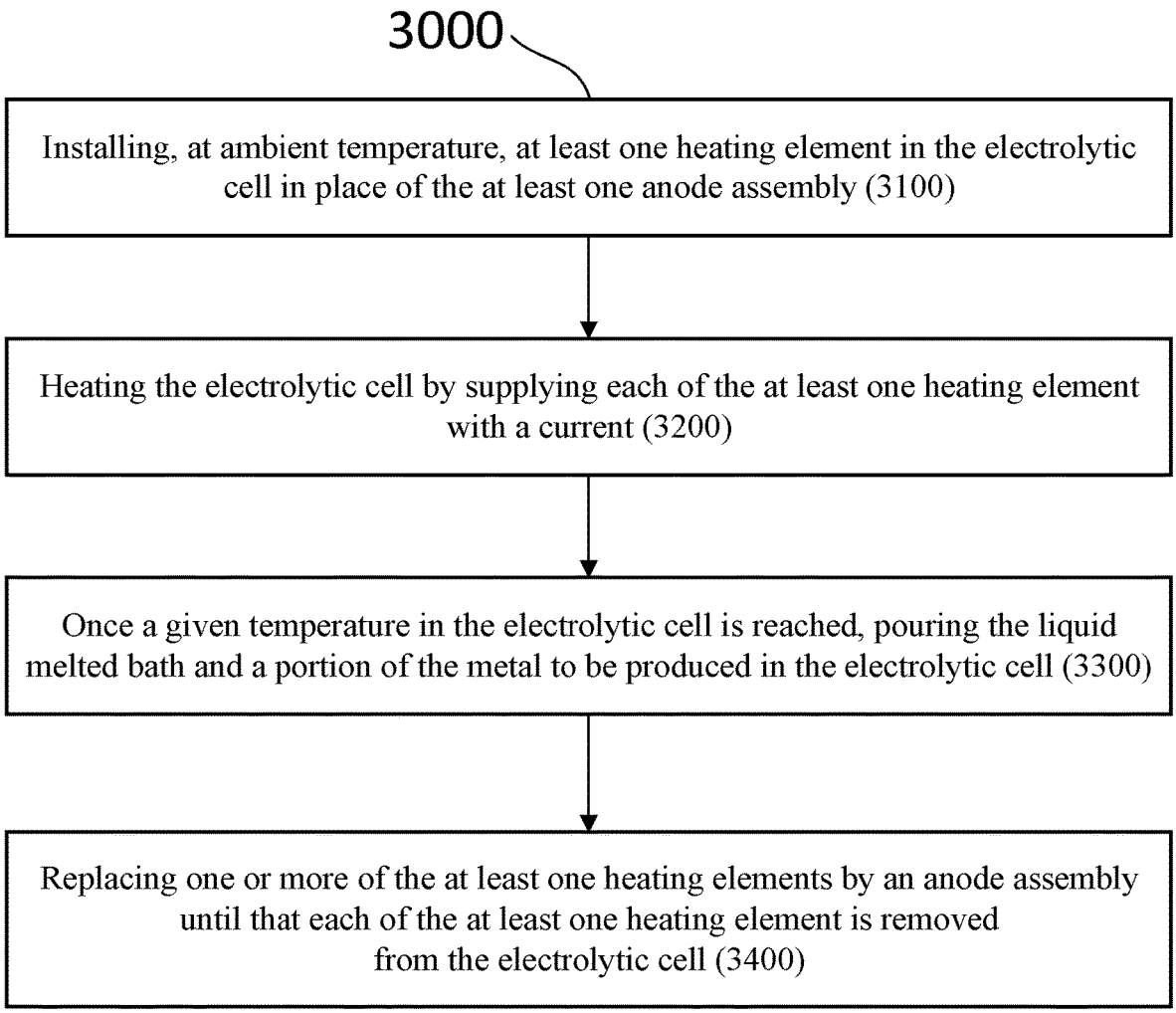
FIG. 15 is flow chart illustrating the starting-up process using a liquid melted bath, according to a preferred embodiment.

FIG. 15 illustrates a starting-up process 3000 when the electrolytic bath is using already liquid, i.e. a hot melted electrolytic bath.

The process 3000 first comprises the steps of installing, at ambient temperature, at least one heating element in the electrolytic cell in place of the at least one anode assembly 3100, before heating the electrolytic cell by supplying each of the at least one heating element with the current 3200. Once a given temperature in the electrolytic cell is reached, the process 3000 comprises the steps of pouring the liquid melted bath and a portion of the metal to be produced in the electrolytic cell 3300. Finally, the process 3000 comprises the step of replacing one or more of the at least one heating element by an anode assembly until that each of the at least one heating element is removed from the electrolytic cell 3400.

The given temperature recited herein is estimated according to the nature of the electrolytic material used for the making of the metal and may be between 700 and 1000° C. (even more) for instance when aluminum is produced from alumina.

Typically, for the starting-up process in accordance with the present invention, the given temperature in the pot is reached after a period of time of several days, such as between 2 to 5 days. The electrolytic bath may comprise alumina for producing aluminum, and a portion of metal, such as aluminum, is used to make the cathodes wettable. Other options to make the cathodes wettable are disclosed in the international patent application No. WO 2018/009862 A1 (LIU, Xinghua), the content of which is incorporated herein by reference. For instance, the aluminum wettable material may at least comprise one of $TiB_2$, $ZrB_2$, $HfB_2$, $SrB_2$, or combinations thereof.

Preferably, the anode assemblies can be preheated outside the cell before being moved and placed in the cell. This is particularly adapted for electrolytic cell using inert or oxygen-evolving electrodes. Reference can be made for instance to the apparatus and method for operating an electrolytic cell disclosed in international patent application No. WO2021/035356 (ELYSIS LIMITED PARTNERSHIP), the content of which is incorporated by reference.

When the resistance $R_{CH}$ of the cell heaters is close or almost equivalent to $R_{AA}$, this may imply the production of a large amount of heat. Accordingly, the process may further comprise the step of evacuating a surplus of heat from the cell. As illustrated in FIG. 10, evacuating the surplus of heat is preferably performed by having at least one additional resistance 130 located on a top section of the at least one heating element 100. Preferably, the surplus of heat is evacuated from the cell via a gas evacuation system located on a top section of the cell above the electrolytic cell. Other ways to evacuate the surplus of heat can be considered without departing from the scope of the present invention.

The process as disclosed herein is particularly advantageous as it can be used for optimizing (e.g. reducing) the time necessary for starting up an electrolytic cell, therefore reducing the amount of energy necessary to start-up the electrolytic cell making the present invention environmentally friendly, while securing the materials located inside the cell (e.g. the inert anodes).

EXAMPLES

Abbreviations typically used in the present specification:

AA: Anode Assembly
GTC: Gas Treatment Center
HH: Hall Heroult
IA: Inert Anode
CTA: Cathode Transport Assembly
PTA: Pot Tending Assembly The cell preheater that is the subject of this invention is an electrical heater that is installed in the cell instead of the anode assembly. The cell is preheated by as many cell preheaters as there are anode assemblies. The cell preheater is powered by the electricity available in the pot main busbar, i.e. using very low voltage (e.g. direct current of 2 to 5 volts) and very high amperage (e.g. of 15 to 50 kA) unlike traditional heating application which are typically an alternating current with higher voltage (110-480V) and lower amperage (few hundred amps).

Another feature is that, at the end of the preheating, when the liquid bath is poured in the cell and the cell preheaters are progressively replaced by the hot anode assemblies, the cell preheater resistance is preferably equivalent or almost equivalent to the resistance of the anode assembly in the bath, so that the electrical and heat distribution of the cell is not unbalanced in the replacement process and the inert anode assemblies take on the desired share of current, without being over or underloaded.

Finally, the cell preheater power is imposed by the potline current and the requirement on resistance. This power P=resistance*amperage^2 is higher that the power required to heat up the cell. Therefore, the cell preheater needs to be able to evacuate surplus energy.

The system, method and starting-up processes disclosed herein allow preheating electrolytic cells using vertical inert anodes and cathode arrangement with a controlled temperature ramp in a uniform way in the whole cell.

The system and method disclosed herein allow to not unbalance the electrical distribution during the progressive replacement of the cell preheaters by the anode assemblies during the cell start-up sequence at the end of the preheating.

Furthermore, through the use of additional resistance that are placed on top of the preheater, the excess energy can be dissipated and does not contribute to further heat up the cell.

Option 1: The Cell Heaters are Connected to the Power Loop (FIG. 7):

An alternative solution for preheating the cell is to power the cell preheaters with a current at 480V. However, given the power involved to heat up a cell (e.g. around 500 kW-1 MW for an AP45 cell) it would mean having a generator close to the cell with 34 big cables to connect to the 17 cell preheaters which generates a big logistic issue at a time when there is little room available around a cell. Even more importantly, it would generate unsurmountable electrical safety issues with 480V AC in a potline and risks of bridging, and a major issue to set the anode assemblies in a very short time to allow to set the potline amperage in the cell without cooling down the pot.

Option 2: The Cell Heaters are Operatively Connected to the Cell Busbar (FIG. 8)

Start-Up Procedure:

- The IA cell is short circuited by shunting the busbar to the next pot in series;
- A first Pot Tending Assembly (PTA) configured to carry each of the cell preheaters and insert the cell preheater inside the IA cell;
- Each cell heater is connected to the pot bus bars;
- The shunts are removed; the pot preheating is started, after a predetermined period of time (e.g about 2-5 days), the electrolytic cell is preheated to the desired temperature and a portion of the metal (e.g. aluminum) and the electrolytic bath are incorporated inside the cell. Each of the cell heaters is electrically disconnected, then removed with the first PTA and immediately replaced by a preheated AA using a second PTA configured to transport an place the preheated AA in the cell while maintaining the temperature of the preheated AA. The second PTA, also known as "Transfer Box", allows avoiding temperature loss of the bath and thermal shock to the equipment, in particular when the AA comprises inert or oxygen-evolving anodes. An example of the second PTA is disclosed in No. WO2021/035356 cited supra.

Parameters:

- The electrical resistance of cell heater and the AA in the cell has to be correctly calculated to get a correct amperage and thermal balance after replacement of the cell preheater by the AA ($R_{CH}$=$R_{AA}$). Alternatively, the resistance can be tuned or modulated to obtain $R_{CH}$=$R_{AA}$.
- Connection of each AA to the equipotential anodic busbar is made.

As aforesaid, time to install all AA inside the electrolytic cell must be short enough to avoid temperature loss and thermal shock to the equipment.

Examples of Preheater System:

As illustrated in FIG. 6, the resistances can be made form solid rod (e.g. made of resistive alloy, e.g. in 40 mm diameter dimension) of different configurations. The resistance design should preferably match the characteristics of the 5VDC nominal cell voltage at a 12,000 A level. The resistivity tolerance covers the window of 12,500 A at 5 VDC, i.e. a nominal 200,000 A at 5 VDC over 16 heater modules. The preheater assembly may comprise steel and refractory material components, both bath resistant, hot face refractory with insulating refractories behind.

The cell start-up is to replace the cell preheater by the AA which has been separately preheated in a preheating box, to avoid a thermal shock of the anodes as disclosed in WO2021/035356 cited supra.

Example: Preheater Assembly (e.g. 63 kW Plug Heater—5VDC—14,400 Amps) may Comprise:

2½" (about 6.35 cm) Sch. 40 Pipe Inconel® 600 Alloy;

1½"*4" (about 6.35*10.16 cm) power leads Inconel® 600 Alloy;

Upper bung Size: 30"*58"*13¾" (76.2*147.32*34.93 cm);

Lifting rings;

Castable refractory lined with block insulation, with refractory anchors;

Support hangers for element pipe; and

Plain steel shipping stand.

While illustrative and presently preferred embodiments of the invention have been described in detail hereinabove, it is to be understood that the inventive concepts may be otherwise variously embodied and employed and that the appended claims are intended to be construed to include such variations except insofar as limited by the prior art.

What is claimed is:

1. A preheating system for preheating an electrolytic cell and for maintaining the preheated electrolytic cell in temperature, wherein the electrolytic cell comprises at least one cathode assembly located at a bottom section of the electrolytic cell and having a plurality of vertical cathodes, and wherein the electrolytic cell is configured for receiving at least one anode assembly, each of said at least one anode assembly comprising a plurality of vertical anodes extending downwardly towards the vertical cathodes once the anode assembly is installed in the electrolytic cell, the vertical anodes being inert or oxygen-evolving anodes extending from a top section of the electrolytic cell toward the cathodes, the at least one anode assembly configured for being preheated outside the electrolytic cell before being moved and placed in the electrolytic cell, the electrolytic cell being further configured to receive an electrolytic bath for the electrolytic production of a metal, wherein the preheating system comprises:

at least one electrical heater, each of the at least one electrical heater being configured to be installed in the electrolytic cell in place of one of the at least one anode assembly and configured for preheating the electrolytic cell before installing said one of the at least one anode assembly into the electrolytic cell;

wherein the electrolytic cell is configured for receiving a number $N_{AA}$ of the at least one anode assembly, with $N_{AA} \geq 1$, the preheating system further comprising:

a number $N_{CH}$ of the at least one electrical heater, with $N_{CH} \geq 1$, each of the at least one electrical heater being configured to be installed in the electrolytic cell in place of the at least one anode assembly, with $N_{CH} = N_{AA}$; and a power module operatively connected to each of the at least one electrical heater and configured for powering the at least one electrical heater with a current for preheating the electrolytic cell, wherein the power module is configured to connect a main busbar of the electrolytic cell to each of the at least one electrical heater for providing the current available in the main busbar; and wherein the preheating system is configured to impose a power P by the current amperage A and the resistance $R_{CH}$ of the number $N_{CH}$ of the at least one electrical heater, with $P=(R_{CH}/N_{CH})*A^2$, and with the power P being then higher than a power required to heat up the electrolytic cell and configured to create a surplus of energy, the electrolytic cell being then configured to evacuate the surplus of energy.

2. The preheating system according to claim 1, wherein the at least one electrical heater is configured for providing a resistance $R_{CH}$ equivalent to a resistance $R_{AA}$ of the at least one anode assembly once installed in the electrolytic bath, so that electrical and heat distribution of the electrolytic cell remain balanced during the replacement of the at least one electrical heater by the at least one anode assembly.

3. The preheating system according to claim 1, wherein the at least one electrical heater is configured for providing a variable resistance $R_{CH}$ which is configured to be tuned to be equivalent to a resistance $R_{AA}$ of the at least one anode assembly once installed in the electrolytic bath, so that electrical and heat distribution of the electrolytic cell remain balanced during the replacement of the at least one electrical heater by the at least one anode assembly.

4. The preheating system according to claim 1, further comprising at least one resistance located on a top section of the preheating system to evacuate said surplus of energy.

5. The preheating system according to claim 1, wherein at least one resistance is located above at least one heating element of the at least one electrical heater.

6. The preheating system of claim 1, further comprising an evacuation mechanism located above at least one heating element of the at least one electrical heater, wherein the evacuation mechanism is configured to evacuate the surplus of energy.

7. The preheating system of claim 1, further comprising a gas evacuation system of the electrolytic cell located on a top section of the electrolytic cell and configured for evacuating the surplus of energy from the cell.

8. The preheating system of claim 1, wherein the power module is configured to directly connect a main busbar of the electrolytic cell to each of the at least one electrical heater for providing the current available in the main busbar.

* * * * *